US011214912B2

(12) United States Patent
Jung et al.

(10) Patent No.: US 11,214,912 B2
(45) Date of Patent: Jan. 4, 2022

(54) AUTOMATIC DETERGENT SUPPLY DEVICE AND WASHING MACHINE HAVING THE SAME

(71) Applicant: Samsung Electronics Co., Ltd., Suwon-si (KR)

(72) Inventors: Euihyun Jung, Suwon-si (KR); Jonghun Sung, Suwon-si (KR); Jeehong Kim, Suwon-si (KR); Kwangmin Chun, Suwon-si (KR); Changwoo Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 112 days.

(21) Appl. No.: 16/537,903

(22) Filed: Aug. 12, 2019

(65) Prior Publication Data

US 2020/0048814 A1 Feb. 13, 2020

(30) Foreign Application Priority Data

Aug. 10, 2018 (KR) ..... 10-2018-0093539

(51) Int. Cl.
*D06F 39/02* (2006.01)
*D06F 39/08* (2006.01)

(52) U.S. Cl.
CPC ..... *D06F 39/022* (2013.01); *D06F 39/085* (2013.01)

(58) Field of Classification Search
CPC ..... D06F 39/022; D06F 39/02–028
See application file for complete search history.

(56) References Cited

U.S. PATENT DOCUMENTS 2,694,555 A * 11/1954 Sinkwich ..... D06F 39/022 366/167.1
9,879,370 B2 1/2018 Jung et al.
2015/0114047 A1 4/2015 Jung et al.
(Continued)

FOREIGN PATENT DOCUMENTS

CN 204000328 12/2014
CN 104894813 6/2017
(Continued)

OTHER PUBLICATIONS

International Search Report dated Nov. 21, 2019 in International Patent Application No. PCT/KR2019/010232.

*Primary Examiner* — Spencer E. Bell
(74) *Attorney, Agent, or Firm* — Staas & Halsey LLP

(57) ABSTRACT

A washing machine includes a main body; a washing tub, and a detergent supply device configured to supply detergent to the washing tub. The detergent supply device includes a detergent housing disposed in the main body and formed with a flow path through which the detergent is suppliable to the washing tub; a detergent case to be disposed inside the detergent housing, to store the detergent inside therein, and formed with a detergent outlet through which the detergent stored inside the detergent case is discharged; and a detergent pump to be connected to the detergent outlet to supply the detergent stored in the detergent case to the flow path, and the detergent case includes a guide member and the detergent outlet of the detergent case is coupleable to the guide member which covers a part of an upper portion of the detergent outlet while coupled to the detergent outlet.

12 Claims, 9 Drawing Sheets

(56) References Cited

U.S. PATENT DOCUMENTS

| | | | |
|---|---|---|---|
| 2016/0258106 | A1 | 9/2016 | Kim |
| 2017/0350834 | A1 | 12/2017 | Prado et al. |

FOREIGN PATENT DOCUMENTS

| | | |
|---|---|---|
| JP | 2005-304669 | 11/2005 |
| JP | 2009-82259 | 4/2009 |
| KR | 10-2005-114779 | 12/2005 |
| KR | 10-2015-0049338 | 5/2015 |
| WO | 2015/133799 | 9/2015 |

* cited by examiner

AUTOMATIC DETERGENT SUPPLY DEVICE AND WASHING MACHINE HAVING THE SAME

CROSS-REFERENCE TO RELATED APPLICATIONS

This application is based on and claims priority under 35 U.S.C. § 119 to Korean Patent Application No. 10-2018-0093539, filed on Aug. 10, 2018, in the Korean Intellectual Property Office, the disclosure of which is incorporated by reference herein in its entirety.

BACKGROUND

Field

The disclosure relates to a detergent supply device with improved detergent supply efficiency and a washing machine including the same.

Description of Related Art

Generally, a washing machine is an apparatus that uses water and a detergent to remove contamination on laundry. The washing machine may rotate a washing tub using a driving force of a motor, and may proceed a series of processes such as washing, rinsing, dehydrating, or the like.

The washing machine may include a water supply device for supplying water. The water supply device is connected to an external water source and may supply washing water to the washing tub.

The washing machine may include a detergent supply device that supplies detergent. The washing water flowing by the water supply device is mixed with the detergent stored in a detergent case while passing through the detergent supply device and then may be supplied to the washing tub by a detergent pump.

The stored detergent may be discharged by the detergent pump along with air introduced into the detergent case. In this case, there is a problem in that the flow rate of the detergent discharged by the air discharged together is not maintained.

SUMMARY

Embodiments of the disclosure address the above disadvantages and other disadvantages not described above. Also, the disclosure is not required to overcome the disadvantages described above, and an embodiment may not overcome any of the problems described above.

According to an embodiment, a detergent supply device capable of maintaining a flow rate of a detergent supplied by a detergent pump constant even if the level of the detergent remaining in a detergent case falls below to a position of a detergent outlet and a washing machine including the same.

According to one embodiment, provided are a detergent supply device and a washing machine including the same, capable of improving the reliability of a product by uniformly supplying the detergent stored in the detergent case to the flow path of the detergent housing.

According to an embodiment, a washing machine includes a main body; a washing tub which is rotatable and disposed inside the main body to accommodate laundry; and a detergent supply device configured to supply a detergent to the washing tub. The detergent supply device includes a detergent housing disposed inside the main body and formed with a flow path through which the detergent is suppliable to the washing tub; a detergent case to be disposed inside the detergent housing, store the detergent inside therein, and formed with a detergent outlet through which the detergent stored inside the detergent case is discharged; and a detergent pump to be connected to the detergent outlet to supply the detergent stored in the detergent case to the flow path, and the detergent case includes a guide member and the detergent outlet of the detergent case is coupleable to the guide member which covers a part of an upper portion of the detergent outlet while coupled to the detergent outlet.

The guide member may include a tunnel in a tubular shape having a bottom that is open, and a cover formed to be perpendicular to an end of the tunnel.

The cover may be formed in a semi-circular shape having a bottom that is open.

The tunnel may be formed to protrude toward an inside of the detergent case.

While the guide member is coupled to the detergent outlet of the detergent case, the tunnel and the cover of the guide member are disposed inside the detergent case.

The detergent supply device may further include a valve coupled to the detergent outlet of the detergent case to open and close the detergent outlet of the detergent case according to an operation of the detergent pump.

The valve may be configured to move backwards and forwards inside the tunnel.

The detergent case may be formed with a detergent inlet in an upper portion to enable the detergent to be introduced into the detergent case, and the detergent inlet in a dented shape with a predetermined depth.

The detergent case may be attachable to and detachable from the detergent housing.

The detergent pump may be disposed in the rear of the detergent case, and the detergent outlet is formed along a rear side of the detergent case.

The detergent housing may be formed with a supply port that is open at a lower portion so as to supply detergent discharged from the detergent case by the detergent pump to the washing tub.

A flow path of the detergent housing may be formed such that a lower surface is inclined toward the supply port to supply the detergent discharged to the washing tub.

According to an embodiment, a detergent supply device to supply a detergent to a washing machine includes a detergent housing formed with a flow path for supplying a detergent to a washing tub, a detergent case to be disposed in the detergent housing, store a detergent inside therein, including a detergent outlet through which the detergent stored inside the detergent case is discharged, and a guide member which covers a part of an upper portion of the detergent outlet so as to discharge the detergent stored in the detergent case through to a lower portion of the detergent outlet, and a detergent pump connectable to the detergent outlet, to discharge the detergent stored in the detergent case to the flow path.

The guide member may include a tunnel in a tubular shape having a bottom that is open, and a cover that is perpendicular to one end of the tunnel and formed in a semi-circular shape with a bottom that is open.

While the guide member is coupled with the detergent case, the tunnel and the cover are disposed inside the detergent case.

BRIEF DESCRIPTION OF THE DRAWINGS

The above and other aspects, features and advantages of certain embodiments of the present disclosure will be more apparent from the following description taken in conjunction with the accompanying drawings, in which.

DETAILED DESCRIPTION

Hereinafter, embodiments of the disclosure are described in more detail with reference to the accompanying drawings. The embodiments described below will be described based on embodiments that are best suited to understanding the technical features of the disclosure, the illustrative features of the disclosure are not limited by the described embodiments, but it is to be understood that the disclosure may be practiced, such as the described embodiments.

The disclosure is capable of various modifications within the scope of the disclosure as described below, and such alternative embodiments are within the scope of the disclosure. In addition, in the figures shown in the accompanying drawings to facilitate understanding of the embodiments described below, the associated elements of the elements that act in the same manner in each embodiment are labeled as the same numbers on numbers on an extension line.

Figure 1:
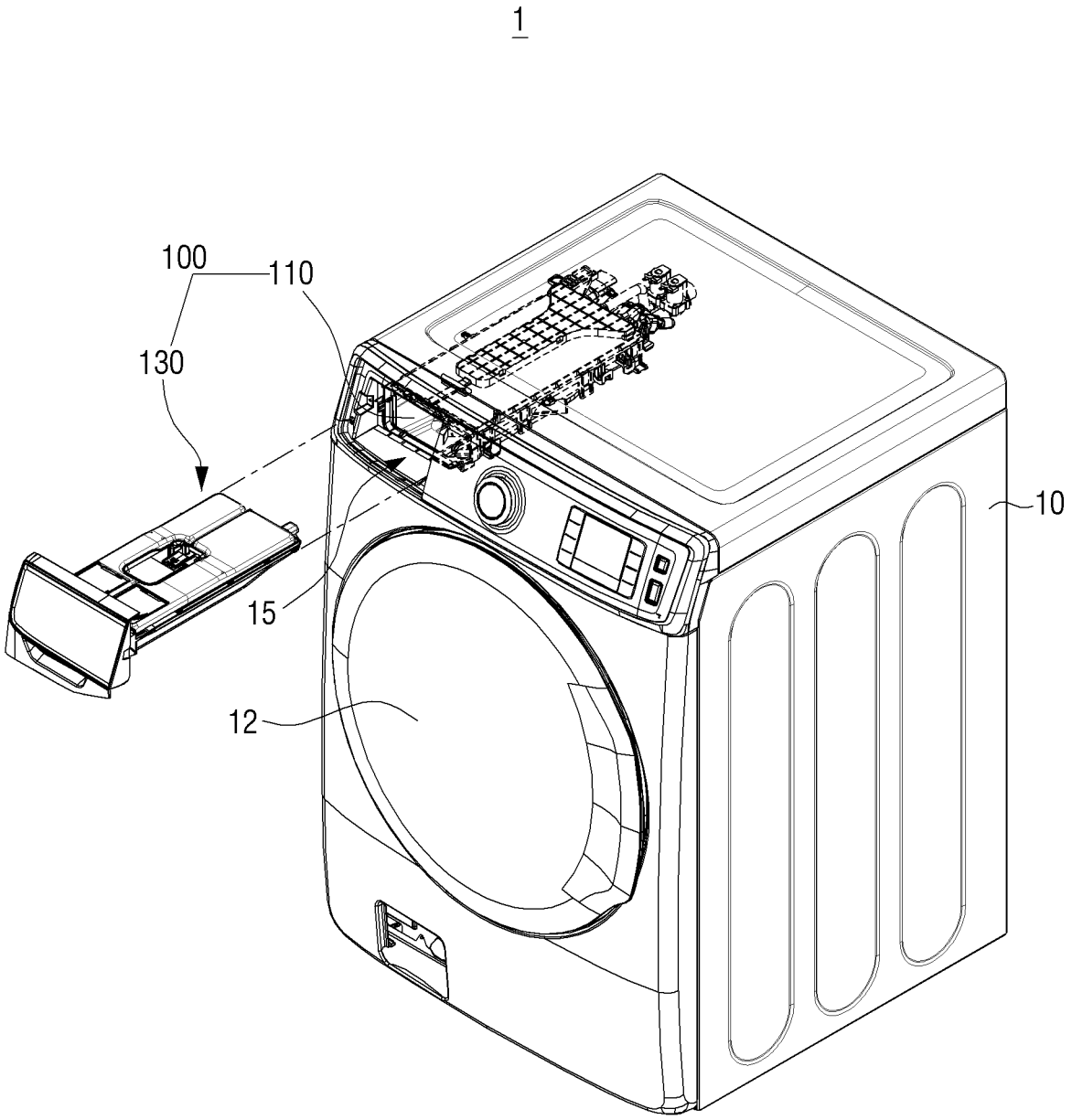
FIG. 1 is a perspective view illustrating an outer shape of a washing machine according to an embodiment.
Figure 2:
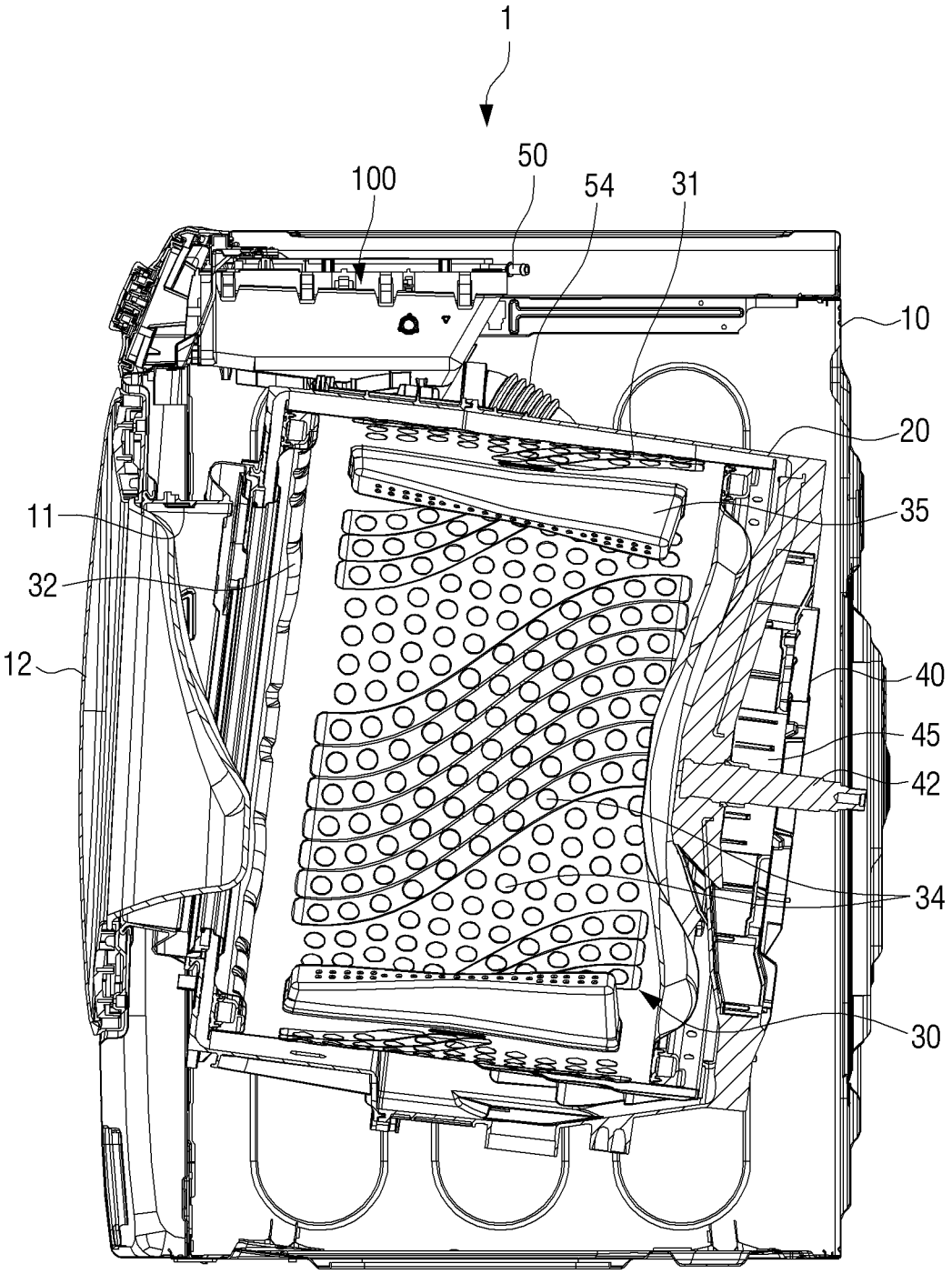
FIG. 2 is a cross-sectional view of a washing machine according to an embodiment.

FIG. 1 is a perspective view illustrating an outer shape of a washing machine according to an embodiment, and FIG. 2 is a cross-sectional view of a washing machine according to an embodiment.

Referring to FIGS. 1 and 2, a washing machine 1 includes a main body 10 which forms an outer appearance and supports various components therein, a washing tub 20 disposed inside the main body 10, a rotating tub 30 rotatably disposed inside the washing tub 20, and a motor 40 for driving the rotating tub 30.

An inlet 11 is formed on a front side so as to input laundry to the inside of the rotating tub 30. The inlet 1 is opened and closed by a door 12 installed on the front side of the main body 10.

A water supply pipe 50 for supplying washing water to the washing tub 20 is installed on an upper portion of the washing tub 20. One side of the water supply pipe 50 is connected to a water supply device (not shown) for supplying washing water from an external water supply source, and the other side of the water supply pipe 50 is connected to the detergent supply device 100.

The detergent supply device 100 is connected to the washing tub 20 through a connection pipe 54 and may supply a detergent to the washing tub 20. The detergent supply device 100 may include a detergent case 130 for storing a detergent, a preliminary detergent, a fabric softener, a bleach, or the like.

The water supplied through the water supply pipe 50 may be supplied to the inside of the washing tub 20 through the detergent case 130 together with a detergent, a preliminary detergent, a fabric softener or a bleach, or the like. The detergent supply device 100 may be inserted into a mounting hole 15 provided in the main body and coupled.

At a lower portion of the washing tub 20, a drainage pump (not shown) for draining water inside the washing tub 20 to the outside of the main body 10 and a drainpipe (not shown) may be installed.

The rotating tub 30 may include a cylindrical portion 31, a front plate disposed in front of the cylindrical portion 31, and a rear plate disposed in the rear side of the cylindrical portion 31. The front plate may have an input port 32 for inputting the laundry, and a driving shaft 42 for transmitting the power of a motor 40 may be connected to the rear plate.

A plurality of through holes 34 for circulating the washing water are formed around the rotating tub 30 and in an inner peripheral surface of the rotating tub 30, a plurality of lifters 35 may be installed so that the laundry may move upward and downward when the rotating tub 30 rotates.

A driving shaft 42 is disposed between the rotating tub 30 and the motor 40. One end of the driving shaft 42 may be connected to the rear plate of the rotating tub 30, and the other end of the driving shaft 42 may be extended to the outside of a real wall of the washing tub 20. When the motor 40 drives the driving shaft 42, the rotating tub 30 connected to the driving shaft 42 may rotate around the driving shaft 42.

A bearing housing 45 may be installed on the rear wall of the washing tub 20 to rotatably support the driving shaft 42. Between the bearing housing 45 and the driving shaft 42, bearings may be installed to allow the driving shaft 42 to rotate smoothly.

Hereinbelow, a structure of the detergent supply device 100 according to an embodiment will be described in detail.

Figure 3:
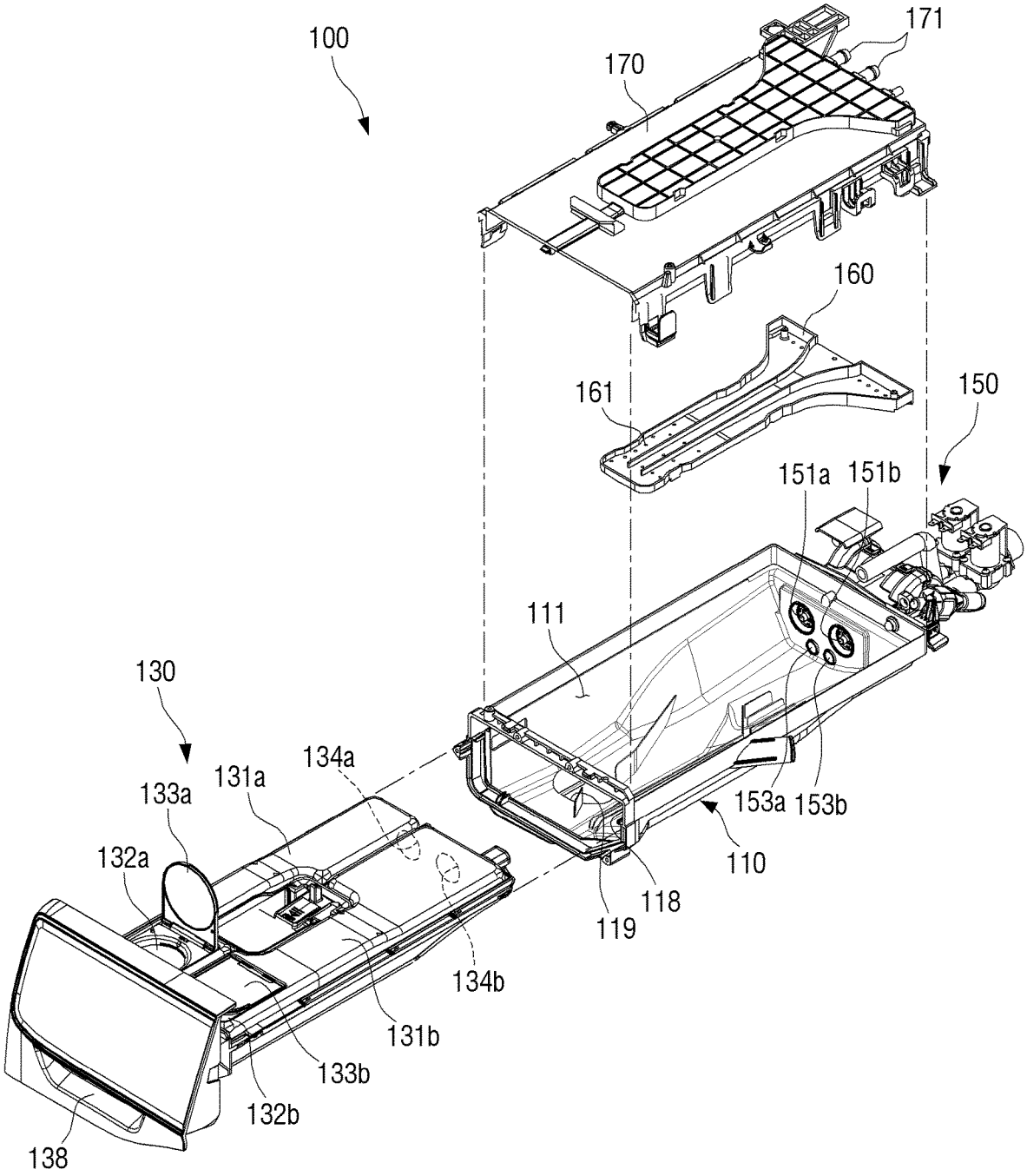
FIG. 3 is an exploded perspective view illustrating a detergent supply device according to an embodiment.

FIG. 3 is an exploded perspective view illustrating a detergent supply device according to an embodiment.

Referring to FIG. 3, the detergent supply device 100 according to an embodiment may be disposed on the main body 10. To be specific, the detergent supply device 100 may be provided on one side of the upper portion of the main body 10.

The detergent supply device 100 may include a detergent housing 110, the detergent case 130 coupled to the detergent housing 110, a detergent pump 150 for pumping stored detergent, a discharge plate 160, and a cover frame 170 for sealing the upper portion of the discharge plate 160.

In the front surface of the detergent housing 110, an opening 118 may be formed, and the detergent case 130 may be inserted into the opening 118 of the detergent housing 110. The detergent case 130 may be detachably coupled to the detergent housing 110.

The detergent case 130 may be provided to slidably withdraw from the detergent housing 110. For example, rails may be provided on both inner sides of the detergent housing 110 so that the detergent case 130 may slidably move while being supported by the rails.

In FIG. 3, it is described that the detergent case 130 is detachably coupled to the detergent housing 110, but the embodiment is not limited thereto, and the detergent case 130 may be disposed inside of the main body 10, while being fixed to the detergent housing 110.

The detergent housing 110 may be of a cylindrical shape having an internal space. Accordingly, the detergent housing 110 may include the detergent case 130 inside the detergent case 130, and a flow path 111 may be formed to serve as a passage through which the detergent and water supplied to the washing tub 20 are discharged.

The flow path 111 formed in the detergent housing 110 may supply detergent to the washing tub 20. In the flow path 111, water flown in through the cover frame 170 and the detergent, or the like, supplied from the detergent case 130 may be supplied to the washing tub 20 through a supply port 119 formed in the detergent housing 110.

The flow path 111 may be formed as a space which is formed by the detergent housing 110 and the cover frame 170, by coupling the cover frame 170 at an upper portion of the detergent housing 110.

A water supply port 171 is formed in the cover frame 170 to allow water to flow in and a separate water supply pipe 50 (see FIG. 1) is connected to the water supply port 171, so that flow in of water to the flow path 111 is available.

The detergent housing 110 may further include a discharge plate 160 in which a plurality of through holes 161 are formed therein to uniformly discharge water flown in through the water supply port 171 at the upper portion of the flow path 111. The discharge plate 160 may be provided to form a space at a lower portion of the cover frame 170, and the discharge plate 160 may be provided in the cover frame 170 fixedly or separably.

A supply port 119 is formed at a lower portion of the detergent housing 110 so that detergent (fabric softener, bleach, or the like) mixed with water may be supplied to the outside of the detergent supply device. The supply port 119 may be connected to a connection pipe 54, and the detergent, which is mixed with water discharged through the supply port 119 may pass through the connection pipe 54 and may be supplied to the inside of the washing tub 20. A lower surface of the detergent housing 110 may be inclined toward the supply port 119 so that the detergent mixed with water is not piled at the bottom of the detergent housing 110 and may be naturally discharged through the supply port 119.

The detergent case 130 may store a main detergent (powder detergent or liquid detergent), preliminary detergent, a fabric softener, and a bleach. The detergent case 130 may be divided into a first detergent case 131*a* positioned on the left side to store the main detergent, and a second detergent case 131*b* positioned on the right side to store the preliminary detergent, a fabric softener, a bleach, and the like.

At one side of the first detergent case 131*a*, a detergent inlet 132*a* through which detergent is input may be formed, and a door 133*a* to be opened and closed may be provided in the detergent inlet 132*a*. At one side of the second detergent case 131*b*, a detergent inlet 132*b* through which the preliminary detergent, fabric softener, bleach, or the like, is input may be formed, and the door 133*b* which may be opened and closed may be provided on the detergent inlet 132*b*.

The detergent case 130 may be formed in a downward direction of the detergent inlet in a dented shape with a predetermined depth, to store detergent, or the like, therein.

In the detergent case 130, a detergent outlet 134*a*, 134*b* formed to discharge detergent may be formed. To be specific, in the first detergent case 131*a*, the detergent outlet 134*a* for discharging the stored detergent may be formed, and in the second detergent case 131*b*, the detergent outlet 134*b* for discharging the stored preliminary detergent, the fabric softener or the bleach, etc. may be formed.

The detergent outlet 134*a*, 134*b* may be formed in a horizontal direction of the detergent case 130. Here, the horizontal direction of the detergent case 130 may mean a direction that is horizontal to a level of detergent stored inside the detergent case 130.

The detergent outlet 134*a*, 134*b* may be formed to be horizontal to a lower surface of the detergent case 130, and may be formed at a bottom of the detergent case 130. The detergent outlet 134*a*, 134*b* may be formed at a side surface except a lower surface and an upper surface of the detergent case 130.

The detergent outlets 134*a* and 134*b* may be formed on a rear side of the detergent case 130, and may be connected to the detergent pump 150 disposed at the rear of the detergent case 130 to be described later for discharging the detergent stored in the detergent case 130. The detergent outlets 134*a* and 134*b* may be connected to the detergent pump 150 in a horizontal direction.

In order to keep the flow rate of the detergent discharged to the detergent pump 150 constant, in the detergent outlets 134*a* and 134*b*, a guide member 120 (see FIG. 4) for guiding the detergent to be discharged to the lower portion of the detergent outlets 134*a* and 134*b* may be coupled. The structure of the guide member 120 will be described later with reference to FIGS. 4 to 6.

In the front side of the detergent case 130, a gripping portion 138 may be provided so that a user may take out the detergent case 130 from the detergent housing 110 or put the detergent case 130 in the detergent housing 110.

The detergent pump 150 may be electrically connected to a processor (not shown) provided in the main body 10 of the washing machine for operating. The detergent pump 150 may be located at a space separated from the flow path 111 of the detergent housing 110 through which water and detergent flows in and out and the detergent case 130.

The detergent pump 150 may be formed at the rear side of the detergent case 130 and the detergent housing 110. The detergent pump 150 may pump the detergent in the detergent case 130 and supply the detergent to the flow path 111 of the detergent housing 110 to supply the detergent in the detergent case 130 to the washing tub 20.

A plurality of the detergent pumps 150 corresponding to the first detergent case 131*a* and the second detergent case 131*b*, respectively, may be provided so as to automatically pump the detergent, preliminary detergent, fabric softener, or the like, respectively.

The detergent pump 150 may include a detergent suction port 151*a* for sucking detergent stored in the first detergent case 130*a* and a detergent suction port 151*b* for sucking the preliminary detergent, fabric softener, bleach, or the like, stored in the second detergent case 130*b*.

The detergent pump 150 may also include a detergent supply port 153*a* for supplying the detergent sucked from the suction port 151*a* to the detergent housing 110 and a detergent supply port 153*b* for supplying the preliminary detergent, fabric softener, bleach, or the like, sucked from the suction port 151*b* to the detergent housing 110.

The detergent suction ports 151*a* and 151*b* and the detergent supply ports 153*a* and 153*b* may be formed to be opened toward the flow path 11*l*. The detergent suction ports 151*a* and 151*b* may be detachably coupled to the detergent outlets 134*a* and 134*b* of the detergent case 130. The detergent supply ports 153*a* and 153*b* may be formed to be in direct communication with the flow path 11 of the detergent housing 110.

In each detergent suction port 151*a* and 151*b*, a valve 140 may be included so that detergent, preliminary detergent, fabric softener, bleach, or the like, may be sucked.

Hereinbelow, the structure of a guide member 120 coupled to the detergent case 130 according to an embodiment will be described in detail. Since the structure of the first detergent case 131*a* and the second detergent case 131*b* are identical, the configuration of the first detergent case 131*a* illustrated in FIGS. 4 to 6 may be equally applicable to the second detergent case 131*b*.

Figure 4:
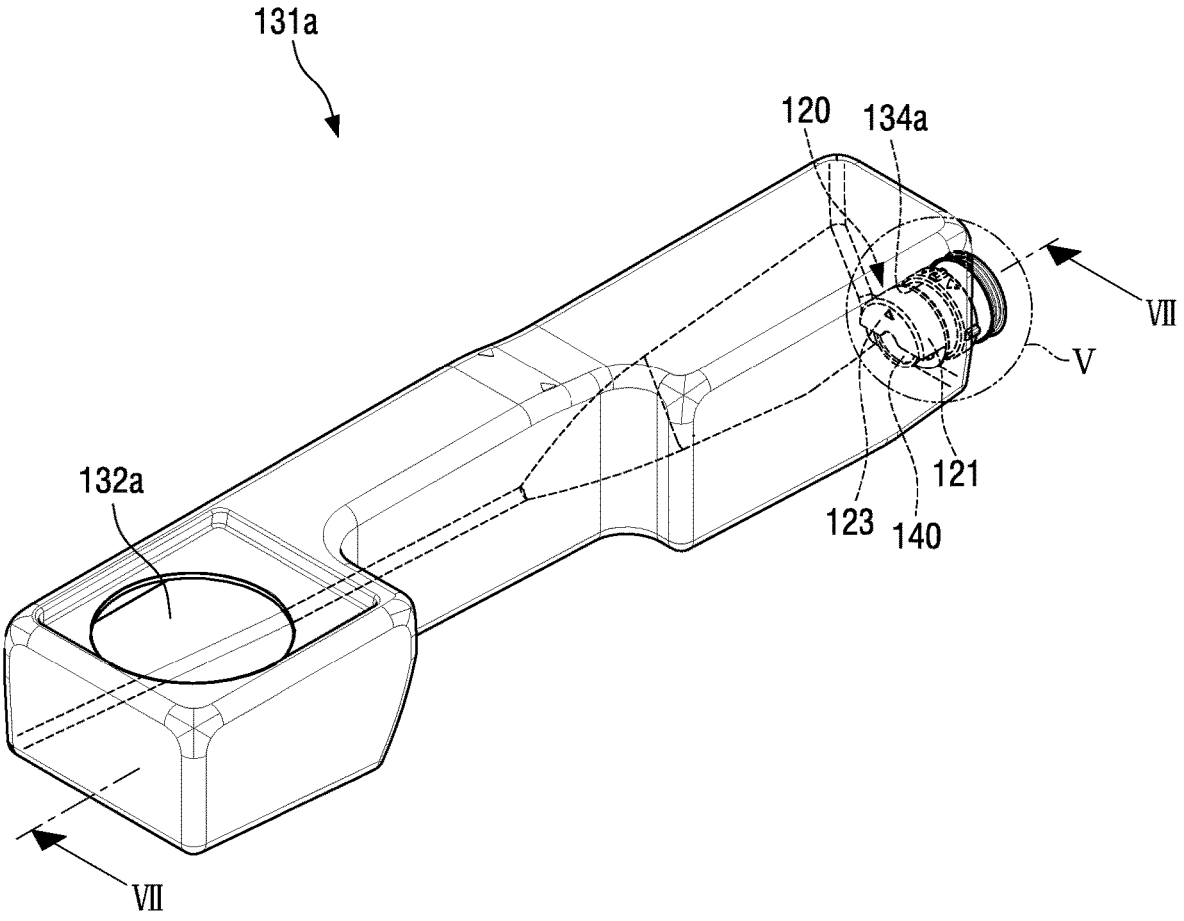
FIG. 4 is a perspective view illustrating the inside of a detergent case according to an embodiment.
Figure 5:
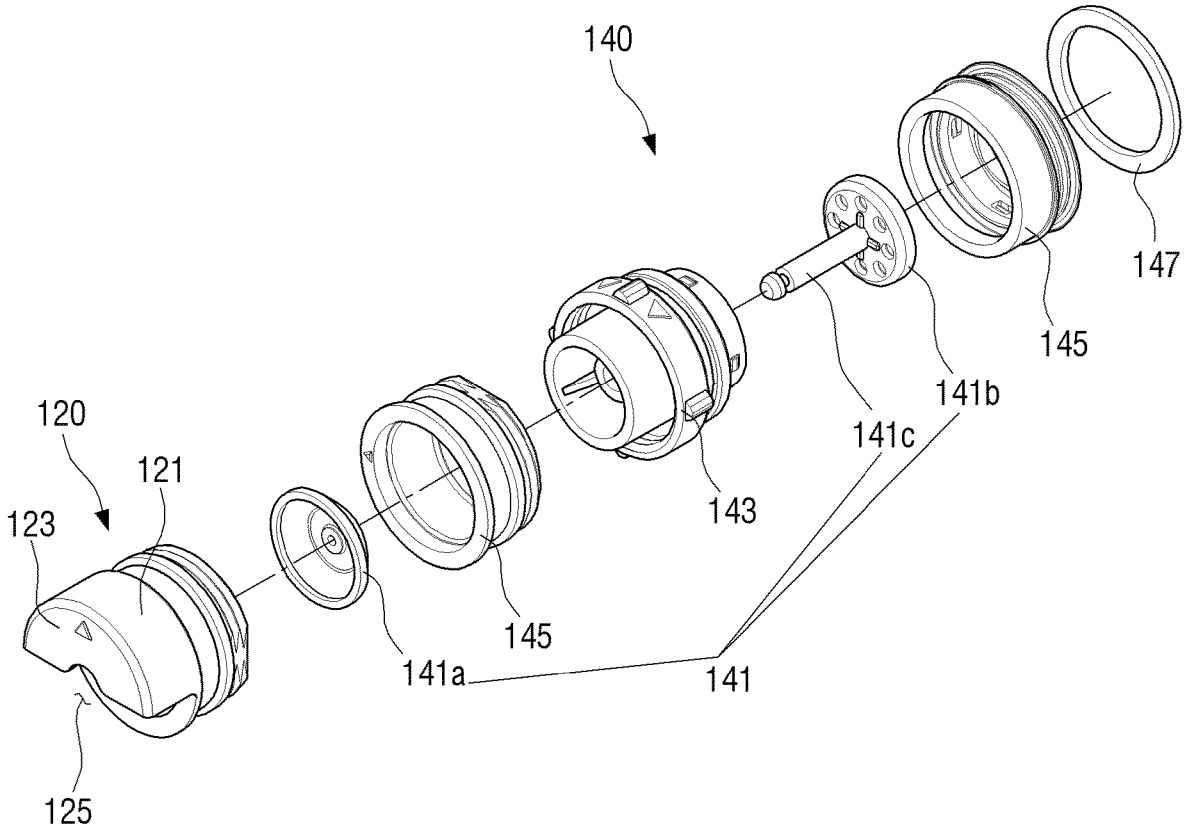
FIG. 5 is an exploded perspective view illustrating V of FIG. 4.

FIG. 4 is a perspective view illustrating the inside of a detergent case according to an embodiment, and FIG. 5 is an exploded perspective view illustrating V of FIG. 4.

Referring to FIGS. 4 and 5, the guide member 120 may be coupled to the detergent outlet 134*a* of the first detergent case 131*a* according to the embodiment.

When the level of the detergent remaining in the detergent case reaches a predetermined height below the position of the detergent outlet, the amount of air discharged with the detergent increases, and the flow rate of the discharged detergent may be decreased. The detergent case 131*a* may include the guide member 120 to keep the amount of the discharged detergent constant.

The guide member 120 guides the stored detergent to be discharged to the lower portion of the detergent outlet 134*a* and may minimize the amount of air discharged with the detergent.

The guide member 120 may cover some of the upper portion of the detergent outlet 134*a*. By the guide member 120, the detergent stored in the first detergent case 131*a* may be discharged to the lower portion of the detergent outlet 134*a*.

The guide member 120 may include a tubular-shaped tunnel 121 and a cover 123 formed to be perpendicular to an end of the tunnel 121.

The tunnel 121 may be formed in a tubular shape having an opened bottom and the tunnel 121 may have a predetermined length to accommodate a valve 140 to be described later. The tunnel 121 may be extensively formed to allow the valve 140 to move backwards and forwards.

The tunnel 121 formed to have a predetermined length may collect detergent that is temporarily discharged, and the amount of discharged detergent may be maximized.

The cover 123 may be formed to be perpendicular to one end of a tunnel, and formed so that a lower portion is opened. The actually stored detergent may be discharged to the detergent outlet 134*a* through the opened lower portion 125 of the cover 123.

Even if the amount of detergent remaining in the detergent case 130 becomes less by the cover 123, the air layer formed above the detergent outlet 134*a* does not directly face the detergent outlet 134*a* and thus, and it may prevent that the pumping effect of the detergent pump 150 is degraded. It is also possible to prevent the flow rate of the discharged detergent from decreasing.

The cover 123 may be formed in a semi-circular shape having an opened bottom 125. It is described that the cover 123 is in a semi-circular shape, but the embodiment is not limited thereto, and the cover 123 may be formed in a shape that may guide the detergent so that the stored detergent is discharged to the lower portion of the detergent outlet 134*a*.

In one example, the cover 123 may be formed to cover at least a part of the upper portion of the detergent outlet 134*a* in an arc shape. The cover 123 may be formed of a plane including an arc of 180 degrees or more and a line connecting one end and the other end of the arc.

Various shapes of the cover 123 will be described in FIGS. 6A, 6B, and 6C.

The guide member 120 may be coupled to the first detergent case 131*a* so that the tunnel 121 and the cover 123 are located inside the first detergent case 131*a*. Accordingly, the tunnel 121 may be formed to protrude toward the inside of the first detergent case 131*a*.

The valve 140 is coupled to the detergent outlet 134*a* to open and close the detergent outlet 134*a* of the first detergent case 131*a* according to the operation of the detergent pump 150. The valve 140 may be arranged to move backwards and forwards inside the tunnel 121 of the guide member 120.

The valve 140 may include an opening and closing member 141 to open and close the detergent outlet 134*a*, a valve guide to guide a backward and forward movement of the valve, and a valve cap 145 so that the valve guide 143 is installed at the detergent outlet 134*a*.

The valve guide 143 may be formed in a hollow cylindrical shape so that a liquid detergent may be temporarily accommodated therein. The opening and closing member 141 may include a valve shaft 141*c* installed to be movable backwards and forwards in the valve guide 143, a first valve portion 141*a* formed of an elastic material and arranged on the upper side of the valve shaft 141*c*, and a second valve portion 141*b* disposed at a lower end of the valve shaft 141*c*.

As the valve 140 advances inward of the first detergent case 131*a*, the detergent outlet 134*a* may be opened, and the detergent stored in the first detergent case 131*a* may move in a direction of the detergent pump 150. The detergent outlet may be closed as the valve 140 moves backward to the outside direction of the first detergent case 131*a*.

A rubber packing 147 may be provided on the outer circumference of the valve 140. The rubber packing 147 may firmly maintain the airtight state of the detergent outlet 134*a* and the detergent suction port 151*a*, 151*b* which are repeatedly attached and detached, so as to prevent the pumping effect from being degraded by the detergent pump 150. In addition, the reliability of the detergent supply device 100 may be improved.

Hereinbelow, an operation state according to an embodiment that the detergent stored in the first detergent case 131*a* is discharged through the detergent pump 150 will be described.

Figure 6A:
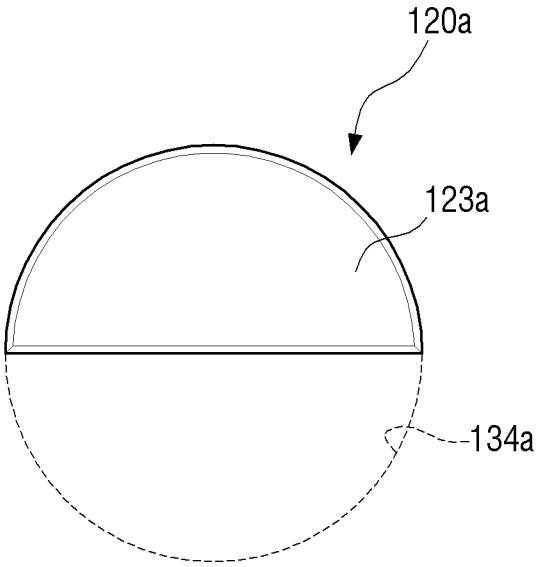
FIGS. 6A, 6B, and 6C are views illustrating a guide member according to various embodiments.
Figure 6B:
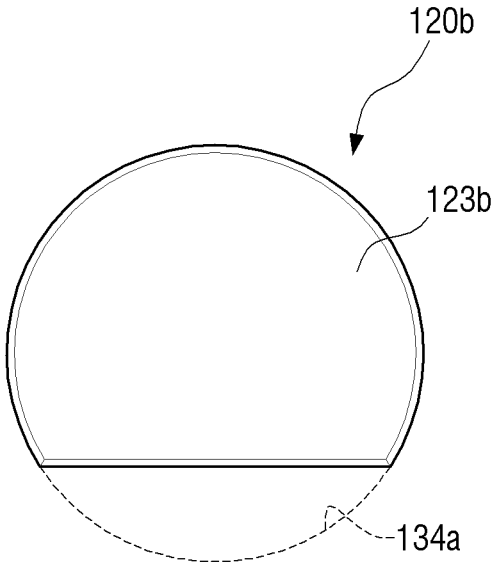
Figure 6C:
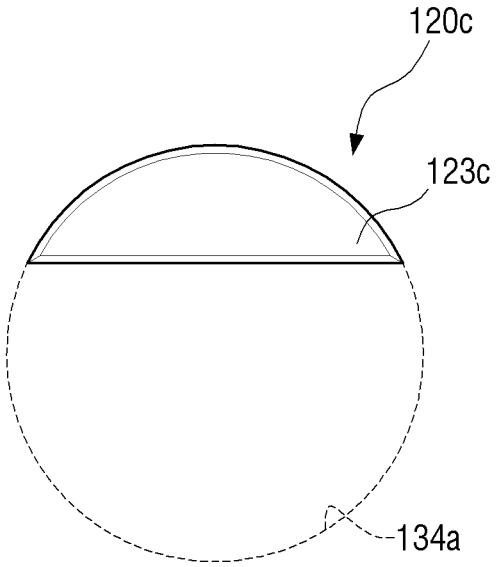

FIGS. 6A, 6B, and 6C are views illustrating a guide member according to various embodiments.

The guide member 120 is to guide the stored detergent to a lower portion of the detergent outlet 134*a*, and the cover 123 may be formed to cover a part of the upper portion of the detergent outlet 134*a*.

In FIGS. 6A. 6B, and 6C, in order to describe a degree of covering the detergent outlet 134*a* by the guide member 120, only the cover 123 of the guide member 120 is illustrated and a relation with the detergent outlet 134*a* is illustrated.

Referring to FIG. 6A, the cover 123 of the guide member 120*a* may be formed in a semi-circular shape with an open lower portion. The cover 123*a* may cover a semi-circular upper portion of the detergent outlet 134*a* and may only discharge detergent into the semi-circular lower portion of the detergent outlet 134*a*.

Referring to FIG. 6B, the cover 123*b* of the guide member 120*b* may be formed with a chord connecting two points below the center of the circular detergent outlet 134*a* and a circular arc made of both end points of the chord.

A cover 123*b* may be formed to cover a half or more of the height of the detergent outlet 134*a*. In this case, the detergent may be discharged to a lower portion of the detergent outlet 134*a* that is opened by the cover 123*b*.

As an example, the cover 123*b* may be formed to cover ⅔ of the height of the detergent outlet 134*a*. The cover 123*b* may be formed of a chord passing ⅔ point below the center of the detergent outlet 134*a* of which the cross section is circle and a circular arc composed of both ends of the chord.

When the cover 123*b* is made of a chord that passes a ⅔ point below the center of the detergent outlet 134*a*, the height of the opened lower portion of the cover 123*b* through which the detergent is discharged may be lowered. Accordingly, the flow rate of the discharged detergent may be maintained even when the amount of detergent remaining in the detergent is small.

Referring to FIG. 6C, the cover 123*c* of the guide member 120*c* may be made of a chord that connects two points above the center of circular detergent outlet 134*a* and a circular arc consisting of both ends of chord. The cover 123*c* may be formed to cover only half the height of the detergent outlet 134*a*.

In one example, the cover 123*c* may be formed to cover ⅓ of the height of the detergent outlet 134*a*. The cover 123*c* may be formed of a chord passing ⅓ point above the center of the detergent outlet 134*a* of which the cross section is circle and a circular arc composed of both ends of the chord.

As the guide member 120 including various covers 123 is provided, even if the level of the detergent remaining in the detergent case 130 is lower than the detergent outlet 134*a*, but it is still higher than the height of the cover 123, the air layer formed above the detergent may not directly face the detergent outlet 134*a*.

Accordingly, it may, be prevented that the pumping effect of the detergent pump 150 is degraded and that the flow rate of the discharged detergent decreases.

Figure 7:
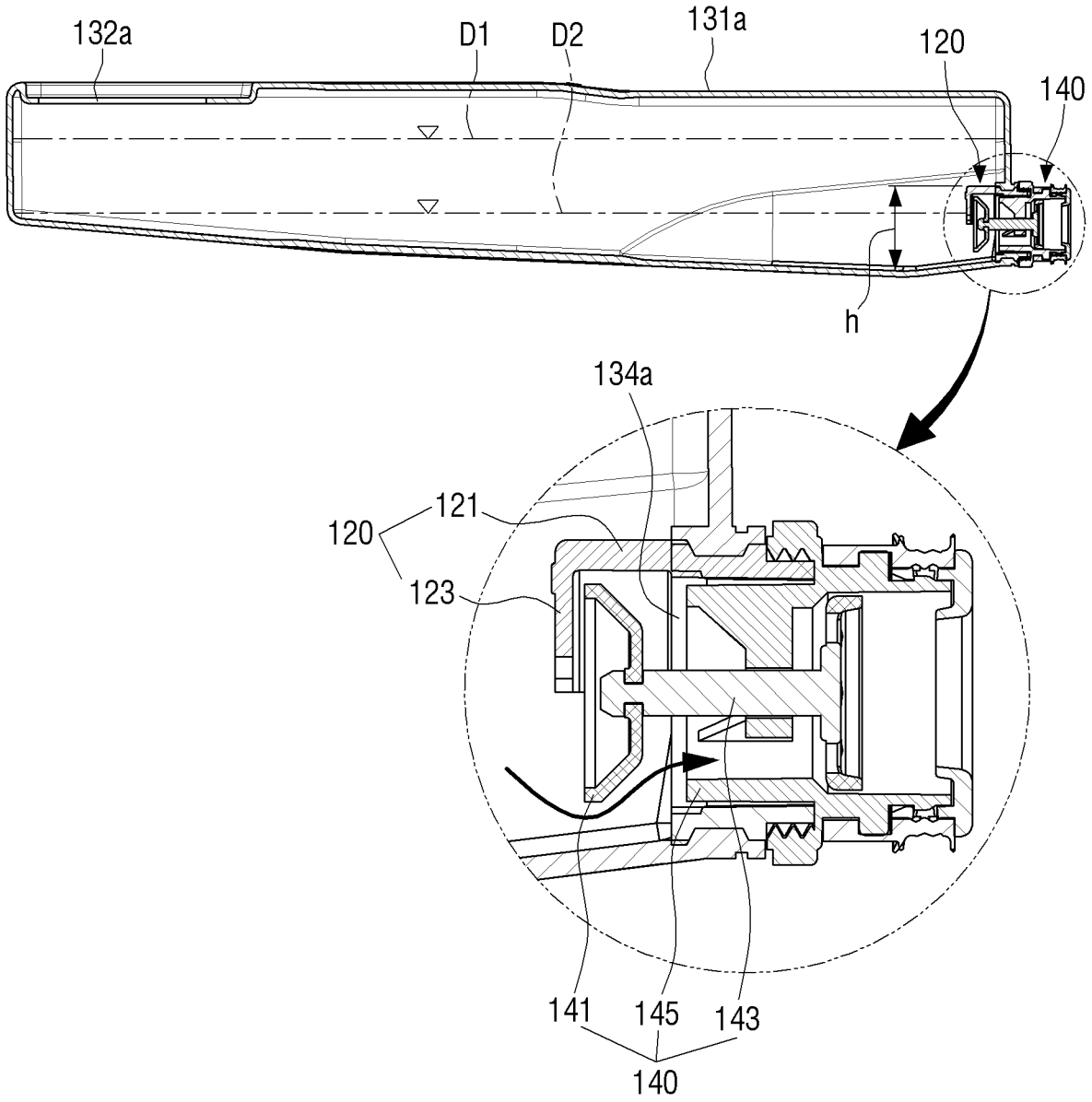
FIG. 7 is a cross-sectional view illustrating along VII-VII line of FIG. 4.

FIG. 7 is a cross-sectional view illustrating along VII-VII line of FIG. 4.

Referring to FIG. 7, when the detergent stored in the detergent case is discharged to the outside by the detergent pump 150, not only the stored detergent but also air in the detergent case may be discharged. In this case, if the level of the detergent D1 stored in the first detergent case 131*a* is higher than the position h of the detergent outlet 134*a*, there may be no change in the flow rate of the discharged detergent.

However, if the level of the detergent D2 stored in the first detergent box 131*a* is lower than the position h of the detergent outlet 134*a*, the amount of detergent discharged according to the amount of air discharged with the detergent may change.

In addition, if the level of detergent stored in the first detergent case 131*a* is not lower than the position (h) of the detergent outlet 134*a*, but is adjacent to the position (h) of the detergent outlet 134*a*, the detergent may be discharged with air due to viscosity of the detergent, causing a change in the flow rate of the discharged detergent.

In order to maintain the flow rate of the discharged detergent to be constant, the detergent supply device 100 according to an embodiment may include the guide member 120 coupled to the detergent outlet 134*a* of the first detergent case 131*a*.

Even when the level of the detergent D2 stored in the first detergent case 131*a* is lower than the position (h) of the detergent outlet 134*a*, a part of the upper portion of the detergent outlet 134*a* is covered by the guide member 120 and thus, the flow rate of the discharged detergent may be kept the same.

As the detergent may be discharged to the lower portion of the detergent outlet 134*a* by the cover 123 of the guide member 120 and there is an effect that the height of the outlet through which the detergent is actually discharged may be lowered.

In this case, the detergents D1 and D2 stored in the first detergent case 131*a* is guided to be discharged to a lower side of the detergent outlet 134*a* by the guide member 120 and thus, it may be minimized that the detergent is discharged along the air remaining inside the first detergent case 131*a*.

By the guide member 120 according to an embodiment, the detergent outlet 134*a* of the first detergent case 131*a* may discharge the same amount of detergent, all the time, regardless of a type of the detergent, and discharge the detergent of the same flow rate regardless of the amount of detergent remaining in the first detergent case 131*a*.

Accordingly, the amount of detergent supplied to the washing tub 20 through the detergent supply device 100 may be maintained at a level greater than or equal to the initial level, during using the washing machine 1.

Although various embodiments of the disclosure have been described in detail above, it should be understood that each embodiment is not necessarily to be implemented solely, and the configuration and operation of each embodiment may be implemented in combination with at least one other embodiment.

While the various example embodiments have been illustrated and described with reference to certain embodiments, the disclosure is not limited to specific embodiments, and it will be understood by those of ordinary skill in the art that various changes in form and details may be made therein without departing from the spirit and scope as defined, for example, by the following claims and their equivalents.

What is claimed is:

1. A washing machine comprising:

a main body;

a washing tub which is rotatable and disposed inside the main body to accommodate laundry; and a detergent supply device configured to supply detergent to the washing tub, wherein the detergent supply device comprises:

a detergent housing disposed inside the main body and formed with a flow path through which the detergent is suppliable to the washing tub;

a detergent case to be disposed inside the detergent housing, to store the detergent inside therein and formed with a detergent outlet through which the detergent stored inside the detergent case is discharged;

a detergent pump to be connected to the detergent outlet to supply the detergent stored in the detergent case to the flow path; and a valve to be coupled to the detergent outlet of the detergent case to open and close the detergent outlet of the detergent case according to an operation of the detergent pump, wherein the detergent case includes a guide member and the detergent outlet of the detergent case is coupleable to the guide member which covers a part of an upper portion of the detergent outlet while coupled to the detergent outlet so as to maintain an amount of the detergent that is discharged from the detergent case constant, wherein the guide member comprises:

a tunnel in a tubular shape having a bottom that is open, and a cover that is perpendicular to one end of the tunnel and formed in a semi-circular shape with a bottom that is open, wherein the valve is configured to move backwards and forwards inside the tunnel.

2. The washing machine of claim 1, wherein the tunnel is formed to protrude toward an inside of the detergent case.

3. The washing machine of claim 1, wherein while the guide member is coupled to the detergent outlet of the detergent case, the tunnel and the cover of the guide member are disposed inside the detergent case.

4. The washing machine of claim 1, wherein the detergent case is formed with a detergent inlet in an upper portion to enable the detergent to be introduced into the detergent case, and the detergent inlet is in a dented shape with a predetermined depth.

5. The washing machine of claim 1, wherein the detergent case is attachable to and detachable from the detergent housing.

6. The washing machine of claim 5, wherein the detergent pump is disposed in a rear of the detergent case, and the detergent outlet is formed along a rear side of the detergent case.

7. The washing machine of claim 1, wherein the detergent housing is formed with a supply port that is open at a lower portion so as to supply detergent discharged from the detergent case by the detergent pump to the washing tub.

8. The washing machine of claim 7, wherein the flow path of the detergent housing is formed such that a lower surface is inclined toward the supply port to supply the detergent discharged to the washing tub.

9. The detergent supply device of claim 1, wherein the guide member maintains a flow rate of the detergent supplied by the detergent pump at a constant level while an amount of the detergent remaining in the detergent case falls below a position of the detergent outlet.

10. A detergent supply device for supplying a detergent to a washing machine comprising:

a detergent housing formed with a flow path to supply detergent to a washing tub;

a detergent case to be disposed in the detergent housing, to store the detergent inside therein, and including a detergent outlet through which the detergent stored inside the detergent case is discharged and a guide member which covers a part of an upper portion of the detergent outlet so as to maintain an amount of the detergent that is discharged from the detergent case constant by discharging the detergent stored in the detergent case through a lower portion of the detergent outlet;

a detergent pump connectable to the detergent outlet, to discharge the detergent stored in the detergent case to the flow path; and a valve to be coupled to the detergent outlet of the detergent case to open and close the detergent outlet of the detergent case according to an operation of the detergent pump, wherein the guide member comprises:

a tunnel in a tubular shape having a bottom that is open; and a cover that is perpendicular to one end of the tunnel and formed in a semi-circular shape with a bottom that is open, wherein the valve is configured to move backwards and forwards inside the tunnel.

11. The detergent supply device of claim 10, wherein while the guide member is coupled with the detergent case, the tunnel and the cover are disposed inside the detergent case.

12. The detergent supply device of claim 10, wherein the guide member maintains a flow rate of the detergent supplied by the detergent pump at a constant level while an amount of the detergent remaining in the detergent case falls below a position of the detergent outlet.

* * * * *